US006745577B2

(12) United States Patent
Newman

(10) Patent No.: US 6,745,577 B2
(45) Date of Patent: Jun. 8, 2004

(54) CHILLING APPARATUS

(75) Inventor: Brian Newman, Chichester (GB)

(73) Assignee: Chilled Concepts Ltd., Barking (GB)

( * ) Notice: Subject to any disclaimer, the term of this patent is extended or adjusted under 35 U.S.C. 154(b) by 0 days.

(21) Appl. No.: 10/181,847

(22) PCT Filed: Jan. 16, 2001

(86) PCT No.: PCT/GB01/00160

§ 371 (c)(1),
(2), (4) Date: Jan. 16, 2003

(87) PCT Pub. No.: WO01/53765

PCT Pub. Date: Jul. 26, 2001

(65) Prior Publication Data

US 2003/0145620 A1 Aug. 7, 2003

(30) Foreign Application Priority Data

Jan. 17, 2000 (GB) ..... 0001048

(51) Int. Cl.[7] ..... F17C 7/02; F17C 9/02; F17C 13/00; F25D 25/00

(52) U.S. Cl. ..... 62/52.1; 62/62; 62/457.9; 62/50.2

(58) Field of Search ..... 62/52.1, 63, 374, 62/384, 50.1, 50.3, 62, 373, 457.9, 50.2

(56) References Cited

U.S. PATENT DOCUMENTS 2,763,994 A * 9/1956 Chandler ..... 62/161
2,860,819 A * 11/1958 Ledingham ..... 222/68
3,000,195 A * 9/1961 Federighi ..... 62/231
3,431,749 A * 3/1969 Bounds et al. ..... 62/293
3,638,442 A * 2/1972 Hedstrom ..... 62/49.2
4,592,205 A * 6/1986 Brodbeck et al. ..... 62/49.2
5,335,503 A * 8/1994 Lee ..... 62/50.1
5,671,604 A * 9/1997 Rudick ..... 62/52.1

FOREIGN PATENT DOCUMENTS

| | | |
|---|---|---|
| CH | 462647 | 10/1968 |
| GB | 2307976 A | 6/1991 |
| JP | 3181764 | 8/1991 |

OTHER PUBLICATIONS

Patent Abstracts of Japan of JP 3–181764 of Aug., 1991.

* cited by examiner

*Primary Examiner*—William C. Doerrler
(74) *Attorney, Agent, or Firm*—Ladas & Parry

(57) ABSTRACT

A chilling apparatus (1) for chilling drinking vessels (44) comprising a liquid gas reservoir (3) in fluid communication with a chilling nozzle (4) under the control of a valve (41) controlled by a control unit (6), so that the drinking vessel may be chilled by a metered quantity of liquid gas vapourising from the chilling nozzle. The reservoir is provided with a vent (36) to prevent a buildup of vapourised liquid gas in the pipework and/or reservoir.

19 Claims, 4 Drawing Sheets

CHILLING APPARATUS

This invention relates to chilling apparatus for chilling drinking vessels.

The use of vapourising liquid carbon dioxide for chilling glass drinking vessels in order to serve beverages therein at a preferred low temperature is known. In known apparatus an inverted drinking vessel is held over a nozzle connected to a carbon dioxide cylinder and the liquid gas is allowed to vaporize in the inverted glass, cooling the glass by absorbing latent heat of vaporization. It is known for the nozzle to be controlled by a simple timing device effectively to provide a metered supply of vapour.

However, as a nozzle valve is open to emit vapour, the pressure in a supply line from the cylinder to the nozzle drops, causing small gas bubbles to form in the supply line. When the nozzle is closed, some of the bubbles may re-liquefy, but the majority collect and eventually form a gas lock in the supply line, causing the apparatus to malfunction. In order to mitigate this problem, it has been necessary to keep the supply line short and place the gas cylinder close to the nozzle. This means the high pressure cylinder must be located in a serving area in which the chilling apparatus is to be used, which is inconvenient and potentially hazardous.

Known apparatus has lacked safety systems and the controls have been difficult to use.

It is an object of the invention to mitigate these disadvantages.

According to the invention there is provided a chilling apparatus for chilling drinking vessels, the apparatus comprising a reservoir for liquid gas, the reservoir being in fluid communication by pipework with a chilling nozzle under the control of metering means, such that a drinking vessel may be chilled by a metered quantity of the liquid gas vapourising from the chilling nozzle, wherein to reservoir is provided with venting means to prevent a build up of vapourised liquid gas in the pipework and/or reservoir.

Conveniently, the liquid gas reservoir is connectable to a remote liquid gas source for maintaining a supply of the liquid gas to the reservoir.

Advantageously, the venting means includes first valve means, and the reservoir is provided with level sensing means to provide a signal to control means to open the first valve means to vent the reservoir when a level of liquid gas in the reservoir is below a predetermined minimum level and to close the valve when the level of liquid is at or above a predetermined maximum level.

Conveniently, the control means includes timing means and is adapted to close the first valve means after a predetermined time from opening the first valve means if the level of liquid gas has not reached the predetermined maximum level.

Advantageously, the control means provides a warning signal and/or shuts down the apparatus when after opening the first valve means the level of liquid does not reach the predetermined maximum level within the predetermined time.

Conveniently, the metering means includes second valve means for controlling emission of vapourising liquid gas from the chilling nozzle controlled by chilling timing means.

Advantageously, the chilling timing means provides a plurality of predetermined emission times for chilling drinking vessels of different sizes.

Preferably, one of the plurality of different predetermined emission times may be selected by operating one of a plurality of push buttons respectively.

Advantageously, the control means includes interlocking means to prevent the first valve means and the second valve means being open at the same time.

Conveniently, the chilling nozzle is provided with a seat for locating an inverted drinking vessel to be chilled over the chilling nozzle.

Preferably, the seat is provided with sufficient passages communicating between the inside and outside of an upturned drinking vessel to vent vapour emitted by the chilling nozzle into the drinking vessel to the outside of the drinking vessel, for the drinking vessel not to be forced from the seat by the emitted vapour.

Conveniently, the apparatus is at least partially located in a housing and hood means.

Conveniently, the housing is adapted for fixing to counter means.

Advantageously, the hood means is adapted to prevent a head of a user being placed close enough to the chilling nozzle to be discomforted or injured by the emission of vapour therefrom.

Preferably, the control means is adapted to monitor the level sensing means and to close the first and second valve means and shut down the apparatus on detecting a malfunction of the level sensing means.

Conveniently, the apparatus is adapted to use carbon dioxide as the liquid gas.

The invention provides the advantage that a high pressure cylinder supplying the apparatus may be located remote from the apparatus. This is more convenient and less hazardous than arrangements used in the prior art. In addition, it means that changing of cylinders may be conveniently carried out by skilled staff, such as cellarmen, rather than by bar staff.

A preferred embodiment of the invention provides the additional advantage that a drinking vessel to be cooled may be located on a seat to be chilled and does not have to be held down over the nozzle as in the prior art.

In another preferred embodiment, the apparatus is provided with a plurality of push-buttons by which different pre-set chilling times for different size drinking vessels or degrees of cooling may be selected.

Further preferred embodiments provide the advantage that the apparatus will shut down safely when the gas cylinder is empty or in the event of certain malfunctions.

The invention will now be described by way of example and with reference to the accompanying drawings in which.

In the figures like reference numbers denote like parts.

Figure 1:
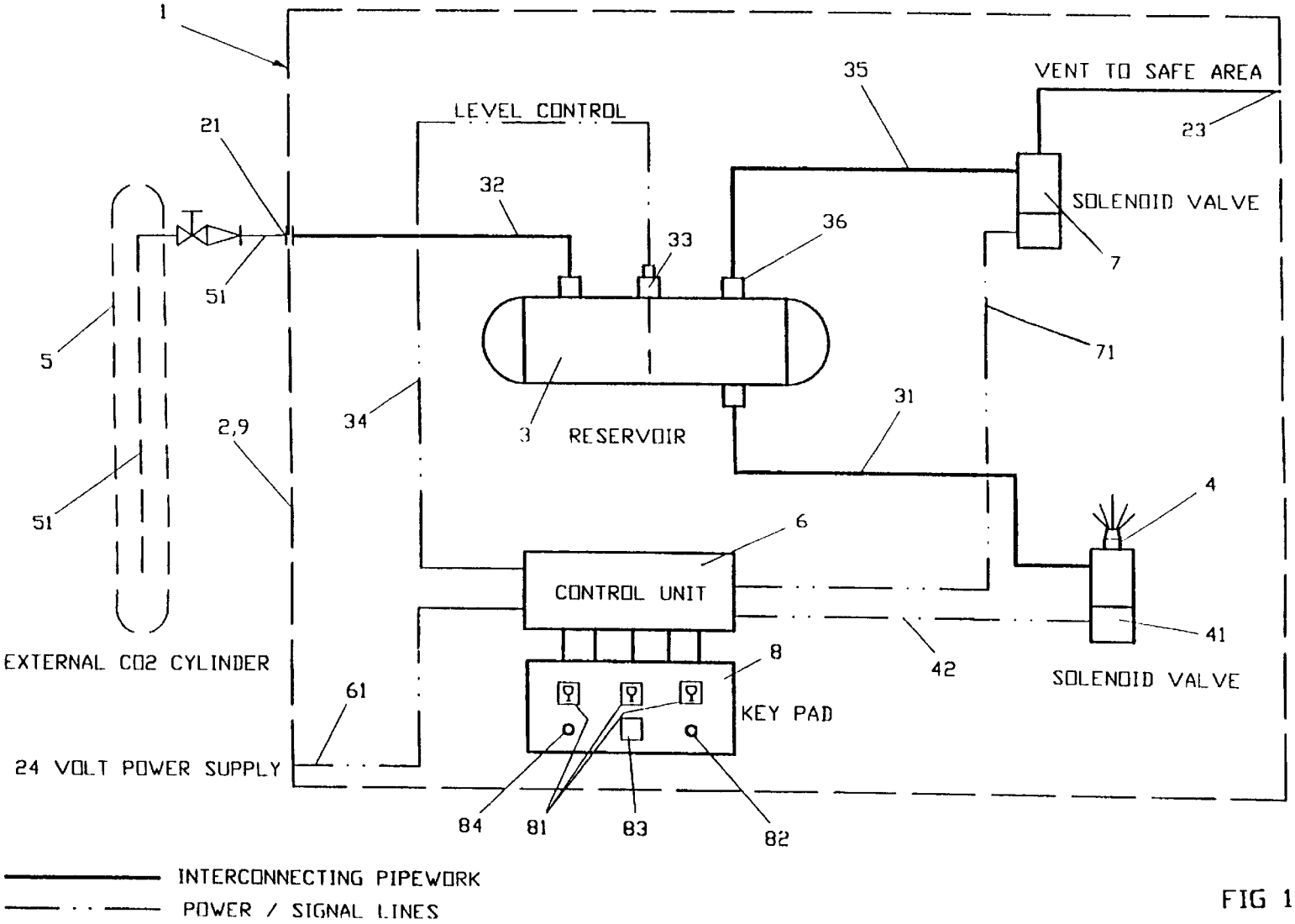
FIG. 1 is a schematic drawing of a chilling apparatus in accordance with the invention.

As seen in the Figures, a chilling apparatus 1, located in a housing 2 and hood 9, comprises a high-pressure reservoir 3 connected by a first pipe 31 to a chilling nozzle 4. The reservoir 3 is connected by a second high-pressure pipe 32 to a connector 21 on a wall 22 (see FIG. 2) of the housing 2 for connection by high-pressure supply pipework 51 to a remote liquid gas cylinder 5. The high-pressure pipework 51 may run to, for example, a cellar via existing pipework routes. The connection of the pipework 51 to the cylinder 5 is so arranged that, even as a level of liquid in the cylinder 5 falls and gas accumulates therein, liquid rather than gas will be supplied from the cylinder 5 to the reservoir 3. This may be achieved by the provision of an internal dip pipe 51 inside the cylinder 5 so that liquid gas is drain from the bottom of the cylinder.

The reservoir 3 is provided with a two-level level sensor 33, for example using thermistors, for sensing predetermined minimum and maximum levels of liquid in the reservoir 3, the sensor 33 being electrically connected by a first signal line 34 to a control unit 6. The reservoir 3 is also provided with a venting outlet 36 connected by a third pipe 35 to a first solenoid valve 7 and thence to a vent port 23 on the wall 22 of the housing 2. Provision may be made to lead venting gas away from the apparatus 1 by further pipework (not shown). The first solenoid valve 7 is also electrically connected by a second signal line 71 to the control unit 6.

Emission of vapour from the chilling nozzle 4 is controlled by a second solenoid valve 41 also electrically connected by a third signal line 42 to the control unit 6.

The control unit 6, Which has a 24 volt electrical supply 61, is also electrically connected to a key pad 8 having three time control push buttons 81, a power switch 82, a stop button 83 and an "empty cylinder" warning light 84.

Figure 2:
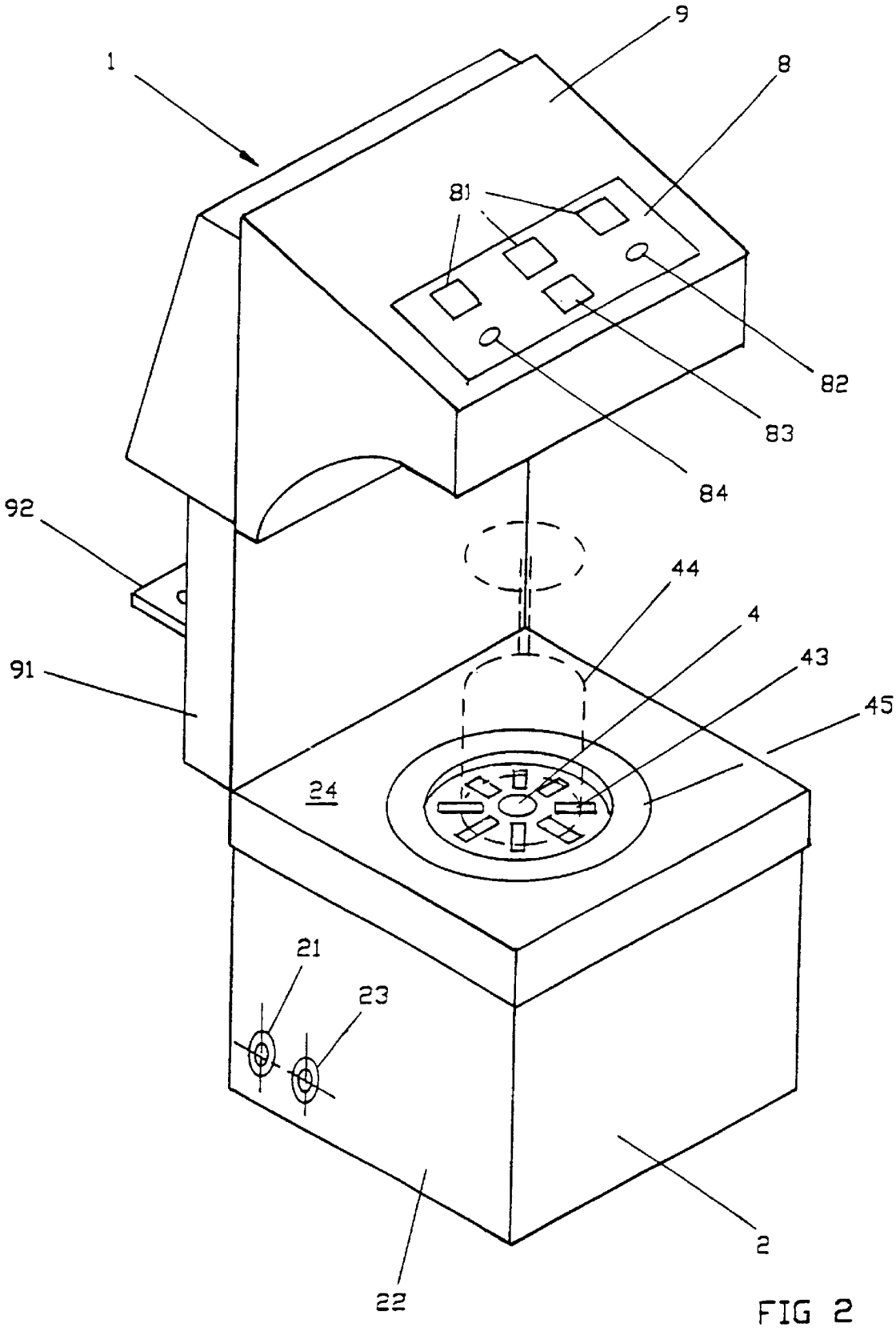
FIG. 2 is a perspective view of the apparatus of FIG. 1.
Figure 4:
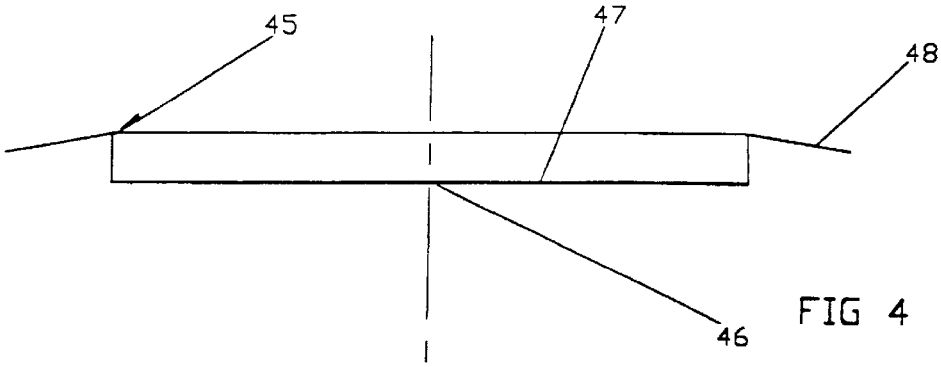
FIG. 4 is a cross-sectional view along the line x—x of FIG. 3.
Figure 3:
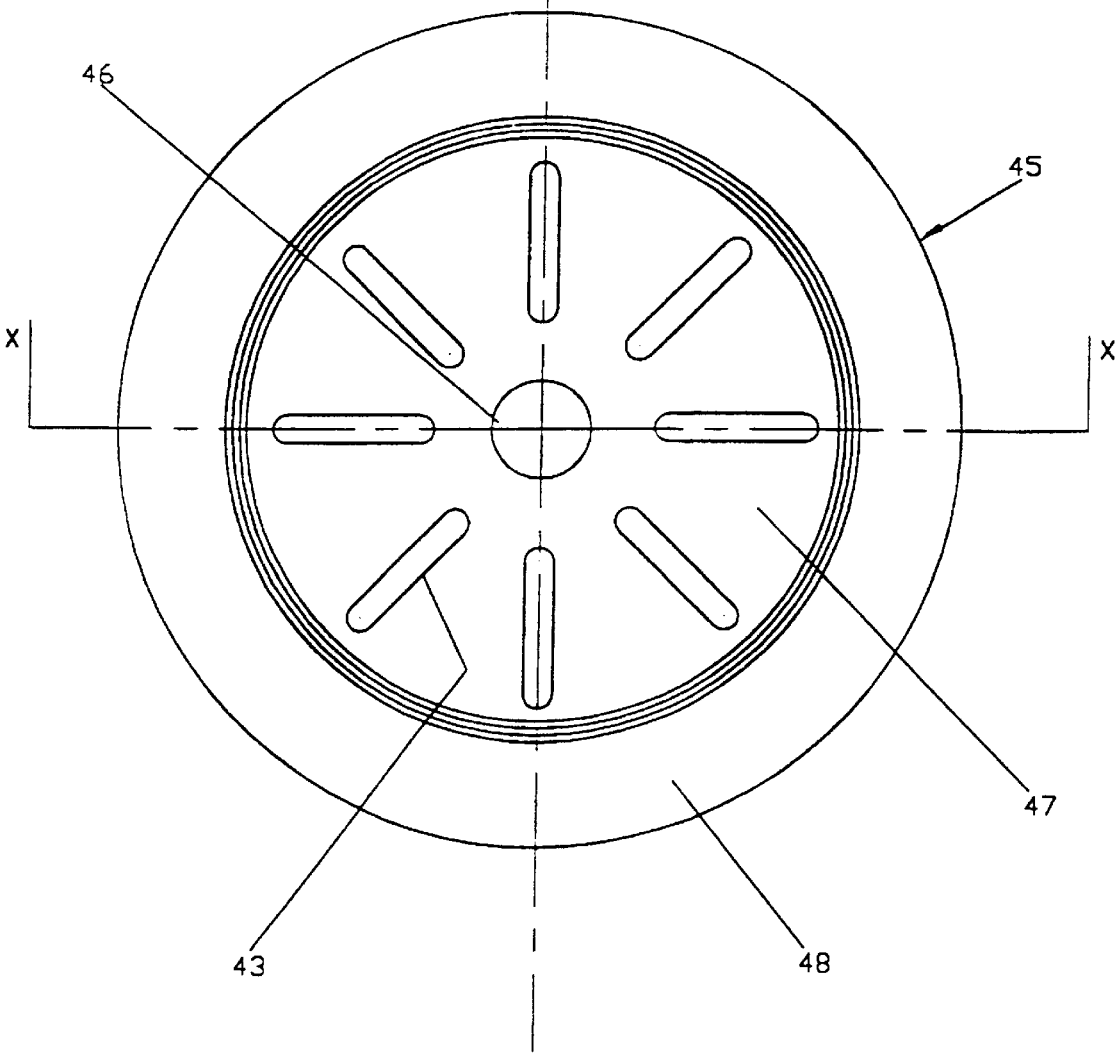
FIG. 3 is a plan view of a seat of the apparatus of FIG. 2 for holding an inverted drinking vessel.

Referring to FIG. 2, the reservoir and solenoid valves are located in a housing 2 at a base of the chilling apparatus 1 in use and the key pad 8 is located on a hood 9 at the top of the apparatus 1 in use. The chilling nozzle 4 is located to protrude through a central aperture 46 in a cylindrical seat 45 recessed into an upper horizontal, in use, face 24 of the housing 2. As best seen in FIGS. 3 and 4, the seat comprises a central recessed portion 47 surround by a concentric raised downwardly, outwardly sloping rim 48. The seat 45 is provided in its base with radial longitudinal slots 43, of length less than the radius of the cylindrical seat 42.

The housing 2 is connected to the hood 9 by a vertical member 91 for housing electrical connections 42, 71, 34 between the control unit 6 housed in the hood 9 and the solenoids 41,7 and the reservoir level sensor 33 located in the housing 2 respectively. A rear face of the vertical member 91 is provided with an orthogonal horizontal panel 92 for attachment of the apparatus 1 to, for example, a bar counter.

In use, a gas cylinder 5 is remotely connected by the supply pipework 51 to the inlet port 21 and thence to the reservoir 3 by the high pressure pipe 32. On first switching the apparatus 1 on, the level sensor 33 senses that a liquid level in the reservoir 3 is not at a predetermined maximum level and signals the control unit 6 which opens the first solenoid valve 7. The reservoir 3 is thus vented and fills with liquid gas from the supply cylinder 5 until the level sensor 33 senses that the level of liquid in the reservoir 3 has reached the predetermined maximum value. The sensor 33 then signals the control unit 6 which closes the first solenoid valve 7 so that pressure in the reservoir 3 rises substantially to the same pressure as in the supply cylinder 5.

In order to chill a drinking glass 44, the glass 44 is inverted and located on the seat 45 with a bowl of the glass covering the chilling nozzle 4. In this position an edge of the bowl bridges the elongate slots 43 in the base of the seat 45. A push-button 81 appropriate to the size of glass 44, and/or the extent of chilling required, is pushed by an operator.

On detecting that a push-button 81 has been pushed the control unit 6 opens the second solenoid valve 41 for a corresponding predetermined time. Liquid gas emerging from the nozzle 4 is de-pressurised and immediately vaporizes, drawing latent heat of vaporization from the immediate surroundings, including the inverted glass 44. The emergent vapour fills the bowl of the glass 44 and flows through the elongate slots 43 and around the outside of the glass 44.

While the second solenoid valve 41 is open, gas bubbles may form in the first pipe 31 from the reservoir and in the reservoir 3 itself. On the re-pressurising of the reservoir 3 and first pipe 31 as the second solenoid 41 is closed, some of these bubbles may be re-liquefied, but the pipework 31 and reservoir 3 are so designed that any remaining bubbles tend to collect in the top of the reservoir 3. After repeated use, this collected gas will force down the level of liquid in the reservoir 3 until the level sensor 33 will sense that the level is below the predetermined minimum level. The control unit 6 will then open the first solenoid valve 7 to vent the reservoir 3 until liquified gas entering the apparatus 1 from the supply cylinder 5 raises the level in the reservoir 3 to the predetermined maximum level. It will be understood that the entry of the supply line 32 into the reservoir is preferably so arranged that gas bubbles will not collect in the supply line 32, although any so collected will tend to be swept into the reservoir 3 by the incoming liquefied gas.

Figure 5:
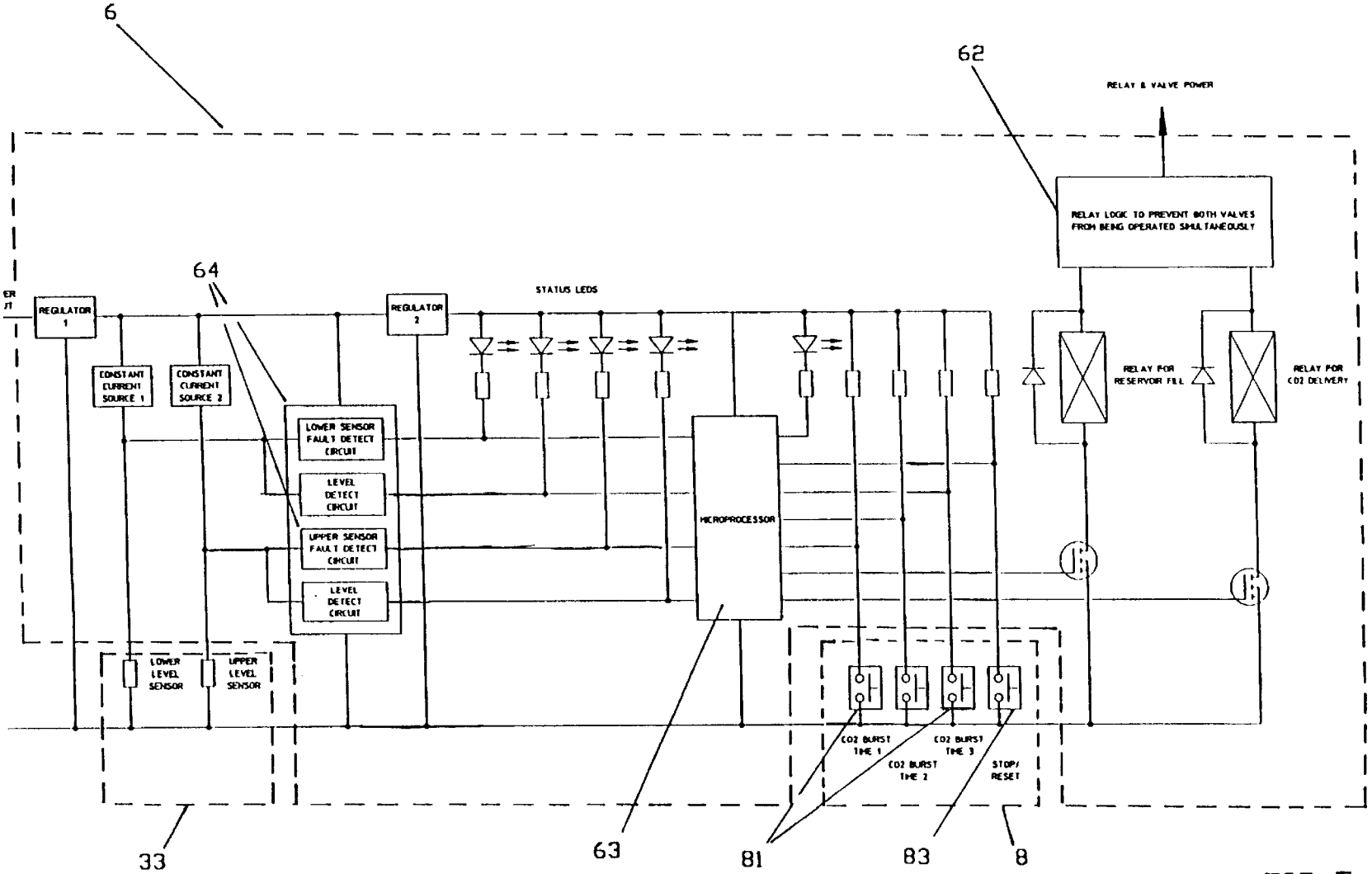
FIG. 5 is a schematic diagram of a control unit of the apparatus of FIG. 1.

Referring to FIG. 5, the control unit 6 is also provided with an interlock system 62 to prevent the first and second solenoids 7, 41 being open at the same time.

The control unit 6 is further provided with a timing mechanism incorporated in a microprocessor 63 so that when the level sensor 33 does not signal that the level in the reservoir 3 has reached the predetermined level within a predetermined venting time after the first venting solenoid 7 is opened, the warning light 84 on the key pad 8 is lit by the control unit to indicate that the supply cylinder 5 needs changing and the control unit signals both the solenoid valves 7, 41 to close.

The control unit 6 is also provided with monitoring means 64, known per se, for monitoring the level sensor 33 and for closing down the apparatus 1 if a malfunction is detected. A manual stop button 83 is also provided on the control pad 8 for closing down the apparatus. The microprocessor 63 also incorporates known self-test and d agnostics facilities to aid trouble-shooting by servile engineers.

As can be seen from FIG. 2, the hood 9 is so designed to overhang the chilling nozzle 4, so that an operator cannot place his or her head close to the chilling nozzle 4 and thereby suffer discomfort or injury.

What is claimed is:

1. A chilling apparatus for chilling a drinking vessel, the apparatus comprising:

(a) a reservoir for liquefied gas;

(b) a chilling nozzle for vapourising said liquefied gas in said drinking vessel;

(c) pipework for conveying said liquefied gas from said reservoir to said chilling nozzle;

(d) metering means for controlling the quantity of liquefied gas dispensed from said chilling nozzle; and (e) venting means in communication with said reservoir for preventing build-up of vapour from said liquefied gas.

2. A chilling apparatus according to claim 1, further comprising a remote source of pressurized liquefied gas in communication with said reservoir.

3. A chilling apparatus according to claim 1, further comprising level sensing means for sensing a level of liquefied gas in said reservoir, said venting means comprising valve means coupled to said level sensing means for venting said reservoir when said level reaches a predetermined minimum.

4. A chilling apparatus according to claim 3, further comprising timing control means for closing said valve means a predetermined time after opening said valve means if said level has not reached a predetermined maximum.

5. A chilling apparatus according to claim 2, further comprising level sensing means for sensing a level of liquefied gas in said reservoir, said venting means comprising valve means coupled to said level sensing means for venting said reservoir when said level reaches a predetermined minimum.

6. A chilling apparatus according to claim 5, further comprising timing control means for closing said valve means a predetermined time after opening said valve means if said level has not reached a predetermined maximum.

7. A chilling apparatus according to claim 5, further comprising safety control means coupled to said level sensor for generating a warning signal if said liquid level does not reach said predetermined maximum level after opening said valve means.

8. A chilling apparatus according to claim 5, further comprising safety control means for shutting down the apparatus if said liquid level does not reach said predetermined maximum level after opening said valve means.

9. A chilling apparatus as claimed in claim 1, wherein said metering means includes chilling timing means and further valve means for controlling the duration of emission of vapourising liquefied gas from said chilling nozzle.

10. A chilling apparatus as claimed in claim 9, wherein said chilling timing means includes means for selecting predetermined duration of emission according to the size of the drinking vessel to be chilled.

11. A chilling apparatus as claimed in claim 10, wherein said selecting means comprises a plurality of user-operable push buttons.

12. A chilling apparatus as claimed in claim 9, further comprising interlocking control means for preventing both valve means from being open at the same time.

13. A chilling apparatus as claimed in claim 1, further comprising a seat for locating an inverted drinking vessel to be chilled over said chilling nozzle.

14. A chilling apparatus as claimed in claim 13, wherein said seat is provided with passages communicating between the inside and outside of said inverted drinking vessel to vent vapour emitted by the chilling nozzle into the drinking vessel to the outside of the drinking vessel.

15. A chilling apparatus as claimed in claim 1, further comprising a housing for enclosing said reservoir.

16. A chilling apparatus as claimed in claim 15, wherein the housing includes means for fixing the apparatus on a support means.

17. A chilling apparatus as claimed in claim 15, further comprising a hood means for preventing access by a user's head to the chilling nozzle.

18. A chilling apparatus as claimed in claim 3, comprising monitoring means coupled to the level-sensing means for shutting down the apparatus in the event of a malfunction of the level-sensing means.

19. A chilling apparatus as claimed in claim 1, wherein the apparatus is connected to a supply of liquid carbon dioxide as the liquefied gas.

* * * * *